US006984196B2

(12) United States Patent
Tornabene et al.

(10) Patent No.: US 6,984,196 B2
(45) Date of Patent: Jan. 10, 2006

(54) ABDOMINAL EXERCISE DEVICE AND METHOD

(75) Inventors: Dean G. Tornabene, 206 Homewood Rd., Los Angeles, CA (US) 90049; Kevin G. Abelbeck, Las Vegas, NV (US)

(73) Assignee: Dean G. Tornabene, Brentwood, CA (US)

( * ) Notice: Subject to any disclaimer, the term of this patent is extended or adjusted under 35 U.S.C. 154(b) by 0 days.

(21) Appl. No.: 10/704,502

(22) Filed: Nov. 7, 2003

(65) Prior Publication Data

US 2005/0101459 A1 May 12, 2005

(51) Int. Cl.
*A63B 26/00* (2006.01)
*A63B 71/00* (2006.01)

(52) U.S. Cl. ..... 482/140; 482/72; 482/142

(58) Field of Classification Search ..... 482/140, 482/142, 72, 907, 95–96
See application file for complete search history.

(56) References Cited

U.S. PATENT DOCUMENTS 4,903,963 A 2/1990 Garnett ..... 272/130
5,752,901 A 5/1998 Lee ..... 482/130
6,022,304 A 2/2000 Tornabene et al. ..... 482/140
6,220,995 B1 4/2001 Chen ..... 482/140
6,302,832 B1 * 10/2001 Stearns ..... 482/96
6,491,611 B1 * 12/2002 Stearns ..... 482/142
6,500,099 B1 12/2002 Eschenbach ..... 482/57

* cited by examiner

*Primary Examiner*—Gregory L. Huson
*Assistant Examiner*—L. Amerson
(74) *Attorney, Agent, or Firm*—Kathy Mojibi Kavcioglu

(57) ABSTRACT

An abdominal exercise machine is provided which includes a seat, which is pivotally linked to a base frame. At least one link includes a handle that can be actuated by a user sitting on the seat. The user presses the handle away from the seat by flexing the trunk muscles of the user. This curls the user's body into a flexed trunk position. As the handle is actuated forward, the linkage arrangement causes the seat to displace upward. This pushes the center of gravity of the user up, thereby doing work and thereby providing resistance to the movement caused by the exercise. The handle may be adjustable in position relative to the link, thereby varying the load used by the user. Foot supports may also be provided either in front of the seat or behind the seat. The foot supports may be mounted to the frame of the seat frame which supports the seat.

23 Claims, 6 Drawing Sheets

ABDOMINAL EXERCISE DEVICE AND METHOD

FIELD OF THE INVENTION

The present invention generally relates to exercise devices. More specifically, the present invention relates to devices that exercise the trunk muscles or the muscles around the abdominal cavity.

BACKGROUND OF THE INVENTION

Abdominal exercise devices have recently gained popularity with the American public. Consumers are flooded with advertising which promise of a midsection with a six-pack yet allowing you to continue to drink as many six-packs as you desire. Though many are inaccurate, the value of strengthened abdominal muscles is well documented in the scientific literature. These core muscles including the rectus abdominis and the internal and external obliques support proper posture and support lower back health. For those with low bodyfat, the sections of the rectus abdominis show through the skin, revealing that prized "six-pack". A true abdominal exercise device must enable a contraction of the main abdominal muscle, the rectus abdominis. This muscle is located on the anterior portion of the abdomen. The action of this muscle is to move the chest toward the groin in such a way as to cause the spine to flex forward. If the chest moves toward the knees with the back straight, the primary movers are the hip flexors (including the psoas muscle). In this case the rectus abdominis contracts only to stabilize the spine to prevent it from bending backward. Any resistive movement of the chest, while it moves forward, thereby curing the spine, results in abdominal muscle stimulation.

SUMMARY OF THE INVENTION

In one aspect, the invention is an abdominal exercise device that features a frame with a first axis and a second axis that are non-collinear. The device also includes a seat frame with a seat portion, the seat frame including a third axis and a fourth axis, which are also are non-collinear. A handle link is included with a handle, the link including a first end pivotally mounted to the first axis and a second end pivotally mounted to the third axis. A guide link is provided with a first end pivotally mounted to the second axis and a second end pivotally mounted to the fourth axis. These elements function together such that when the handle is articulated away from the seat, the seat is displaced relative to the frame.

The device may also include a foot support that is mounted to the seat frame, and preferably movably mounted to the seat frame. The foot support may be positioned opposite to the handle relative to the seat. The foot support may also be mounted to the frame. If mounted to the frame, the foot support is preferably on a same side as the handle relative to the seat.

The handle is preferably adjustably mounted to the handle link. In the preferred embodiment the handle is slideably mounted to the handle link.

The guide link is preferably between 1.5 and 2.0 times the length of the handle link. The optimal relationship as determined by the inventor includes the guide link being 1.7 times the length of the handle link.

In another aspect, the invention includes a method of performing an abdominal exercise including the steps of providing a device as previously specified. The method includes sitting on said seat with said handle anterior to a user's torso. The user grasps the handles with the hands of the user and pressing forward on the handle while generating movement form the user's trunk, thereby flexing the trunk muscles.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
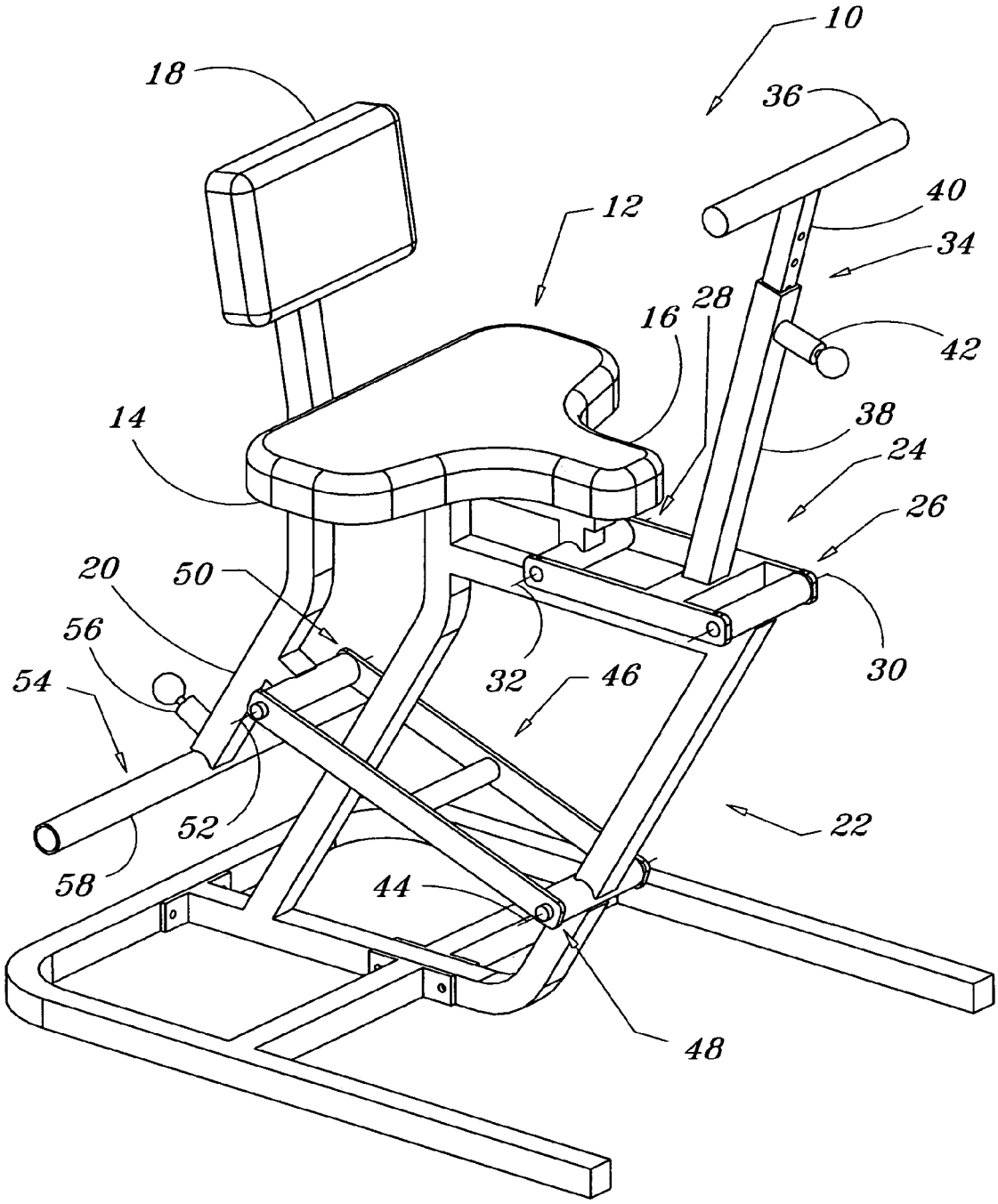
FIG. 1 is an isometric view of an abdominal exercise device with a rear foot support, the device produced in accordance with a version of the present invention.

The present invention is an abdominal exercise device 10. In FIG. 1, this device 10 is shown in one form. The key elements include a seat portion 12 to receive the posterior of a user. A variety of forms of the seat portion 12 can be used, but it is preferable that seat portion 12 enable the user's upper legs to drop below the seat, as does a bicycle seat. This seat 12 has a similar shape in that it provides a wide rear base 14 and a narrower front section 16. This combination provides comfortable support. A seat back 18 may also be used and may be provided adjacent to the seat portion 12. The seat back 18 allows for support from posterior forces applied to the device 10 by the user. The seat back 18 may be desired but need not always be used in all forms of the present invention.

The seat portion 12 is mounted to a seat frame 20. The seat frame 20 not only supports the seat 12 and seat back 18, when provided, but also provides an axial support to the base frame 22. The base frame 22 provides a base of support for the seat 12 and a user positioned thereon. The seat frame 20 is pivotally mounted to the base frame 22 by way of a "4-bar link". A 4-bar link is many times referred to as a "parallel link". A 4-bar link includes two movable and two stationary links. In many cases the stationary links are part of the frames on either ends of the movable links. By altering the link lengths and positions, the two moving links may not always be parallel, as is implied by the name "parallel link". This is the case in the present invention. Though a parallel arrangement could be functional, the optimal arrangement is for the links to be of different lengths to provide a seat 12 movement that tilts slightly back (posteriorly) as the seat 12 is elevated relative to the base frame 22.

The upper moving link of the device 10 is the handle link 24. The handle link 24 includes a first end 26 and a second end 28. The first end 26 is adapted to be pivotally mounted to the frame 22 at a first axis 30. The specifics of providing axial movement is not critical in that ball bearings or bushings can be used to provide a sufficient bearing surface. A detailed explanation of the preferred embodiment, including these details, will be outlined later in this disclosure. Near the second end 28 of the handle link 24 is another pivotal mounting, the third axis 32 located on the seat frame 20.

The handle link 24 also includes a handle 34. The handle 34 need only be a suitable engagement for the hands of the user and allow for force to be applied thereto in order to articulate the handle link 24 relative to the frame 22. Here the handle 34 is shown to be adjustable in length. That is desirable in that the user applies force to the handle 34 to create a torque one the handle link 24 about the first axis. Increasing the length of the bar 36 of the handle 34 from the first axis 30, decreases the necessary force applied to the bar 36 of the handle 34 in order to overcome the torque of the weight of the user on the seat 12. The adjustable mounting, or in this case slideable mounting, of the handle to the handle link 24, provides a typical example of this resistance adjustable feature. This adjustment here is provided by a female portion 38 that receives a male portion 40. The bar 36 is mounted to one end of the male portion 40. A lock 42 is used to releaseably secure the male portion 40 to the female portion 38.

The base frame 22 also includes a second axis 44, which is non-collinear with the first axis 30. The second axis 44 provides the pivotal mounting of a guide link 46 with the frame 22. The guide link 46 is the second movable link of the 4-bar link system. The first end 48 of the guide link 46 is pivotally mounted to the frame at the second axis 44. The second end 50 of the guide link 46 is pivotally mounted to the seat frame 20 at a fourth axis 52. The two axes of the seat frame 20, the second axis 32 and the fourth axis 52 are non-collinear, as is shown here.

A final element of the device 10 as is illustrated in this view is a rear foot support 54. The foot support can take a variety of forms and some variations will be illustrated in this disclosure. Here the rear foot support 54 is used which is movably mounted to the seat frame 20. As with the handle 34, a lock 56 releaseably secures a male portion inside a female portion, thereby enabling variable placement of a foot bar 58 relative to the seat 12. The foot bar 58 can also be rigidly mounted to the seat frame 20 and therefore not adjustable.

Figure 2B:
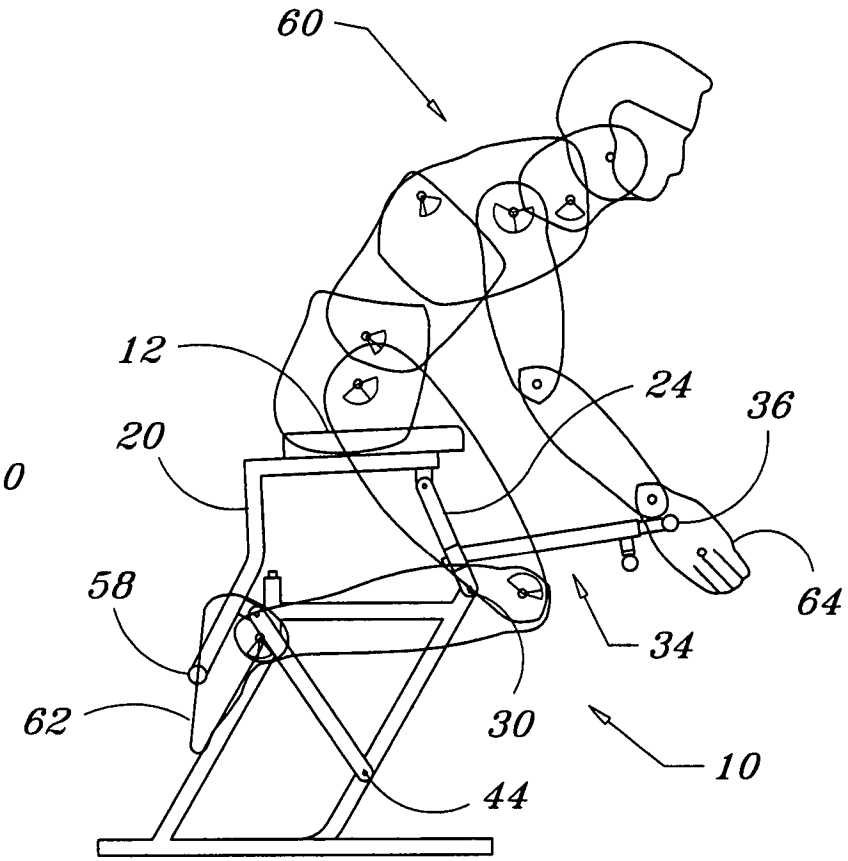
FIG. 2*b* is a side view of an abdominal exercise device with a rear foot support shown in a final position, the device produced in accordance with a version of the present invention.
Figure 2A:
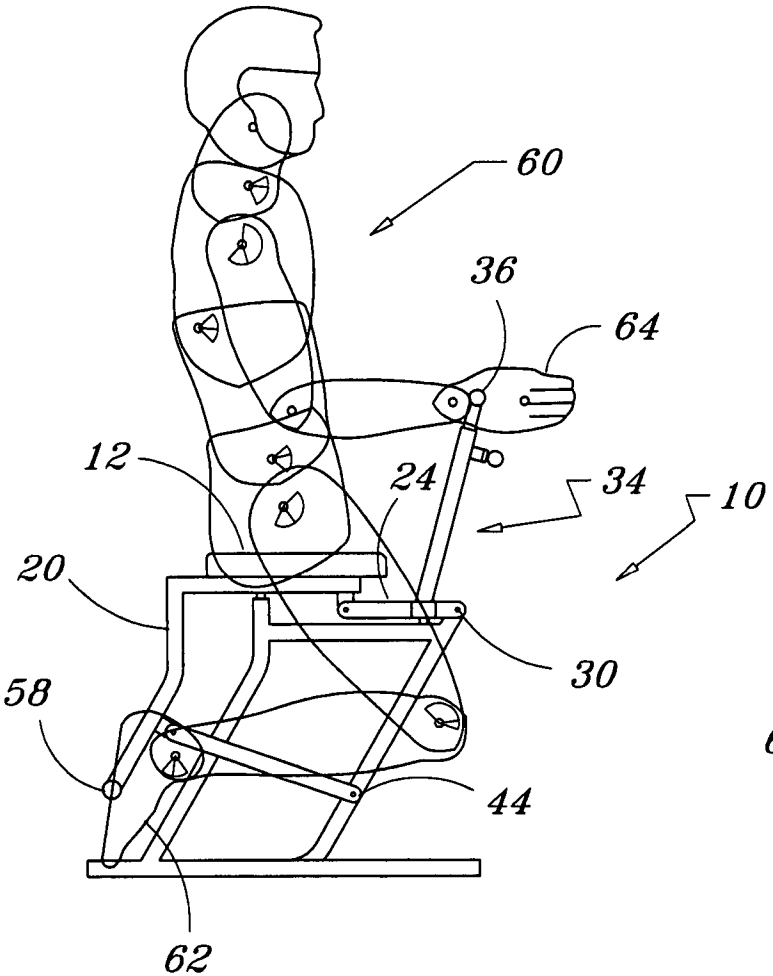
FIG. 2*a* is a side view of an abdominal exercise device with a rear foot support shown in a starting position, the device produced in accordance with a version of the present invention.

The function of the device 10 is more clearly illustrated in FIGS. 2*a* and 2*b*. Here the seat frame does not include a back pad, but does have a seat portion 12 to support a user 60. The unit in a starting position is shown in FIG. 2*a*. The user sits with his feet 62 against the foot bar 58 and his glutes on the seat portion 12. The user's hands 64 are placed on the bar 36 of the handle 34. The user 60 presses against the bar 36 of the handle 34 and supports himself as needed by pushing against the foot bar 58. As the handle 34 is moved forward (anteriorly) the handle link 24 is rotated forward about the first axis 30. This elevates the seat 12 with the user 60, thereby doing work. This raised or final position is illustrated in FIG. 2*b*.

The handle 34 is positioned far enough in front of the user 60 to minimize the movement of the arms of the user 60 to move the handle 34 forward. This necessitates the anterior flexion of the trunk to enable the bar 36 to be "pushed" forward. In addition, since any seat back that may be used is minimal in height, any force applied by the user to push forward with the arms must be countered by contraction of the anterior trunk muscles of the user 60. These include the abdominal muscles. Therefore even if the arm, shoulder and chest muscles provided all the movement, the abdominal muscles would still need to perform an isometric contraction to prevent the upper body from bending backward.

Figure 3B:
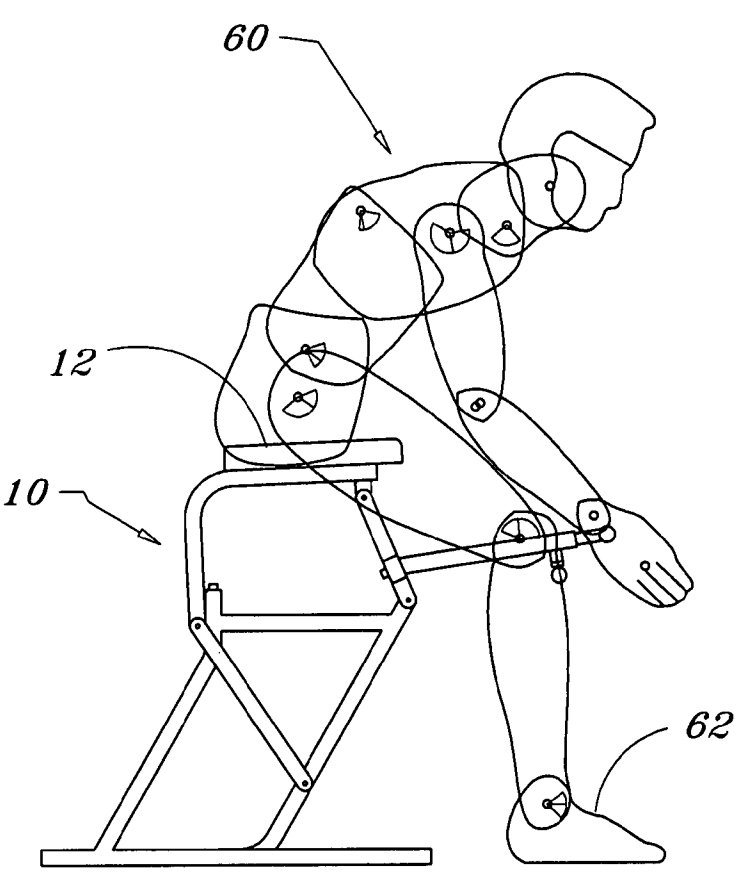
FIG. 3*b* is a side view of an abdominal exercise device with no foot support, the device shown in a final position and produced in accordance with a version of the present invention.
Figure 3A:
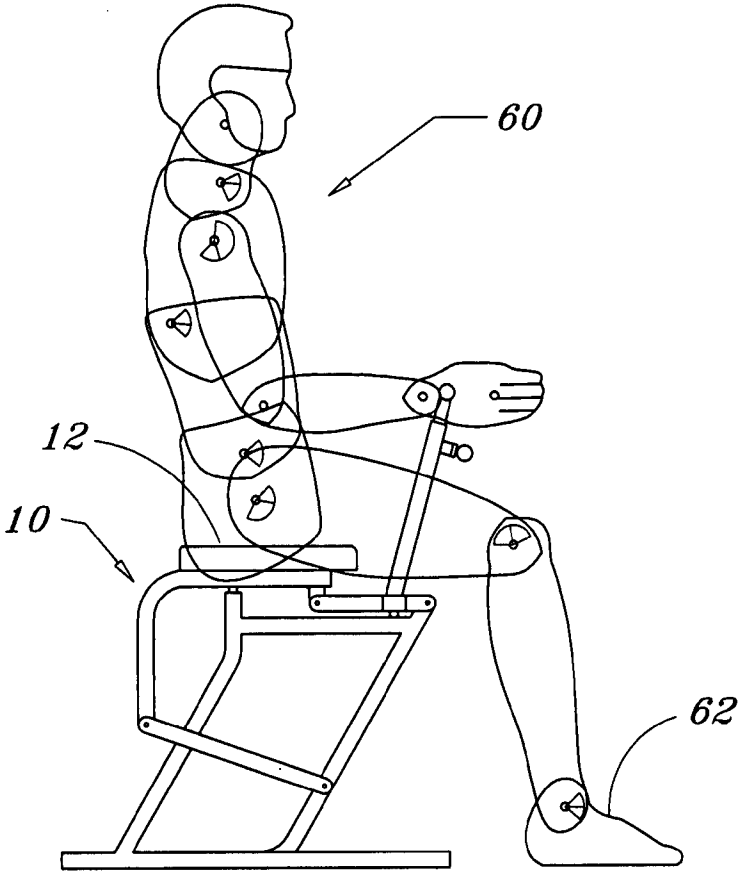
FIG. 3*a* is a side view of an abdominal exercise device with no foot support, the device shown in a starting position and produced in accordance with a version of the present invention.

Another version of the device is shown in FIGS. 3*a* and 3*b*. In this version the foot support has been removed. As such, the user 60 is seated with his feet 62 in a forward position. In this way, the user 60 can extend his legs to assist the abdominal flexion work to raise the seat 12 from the starting position in FIG. 3*a* to the final position in FIG. 3*b*. The general movement of the device 10 is the same as is previously disclosed.

Figure 4:
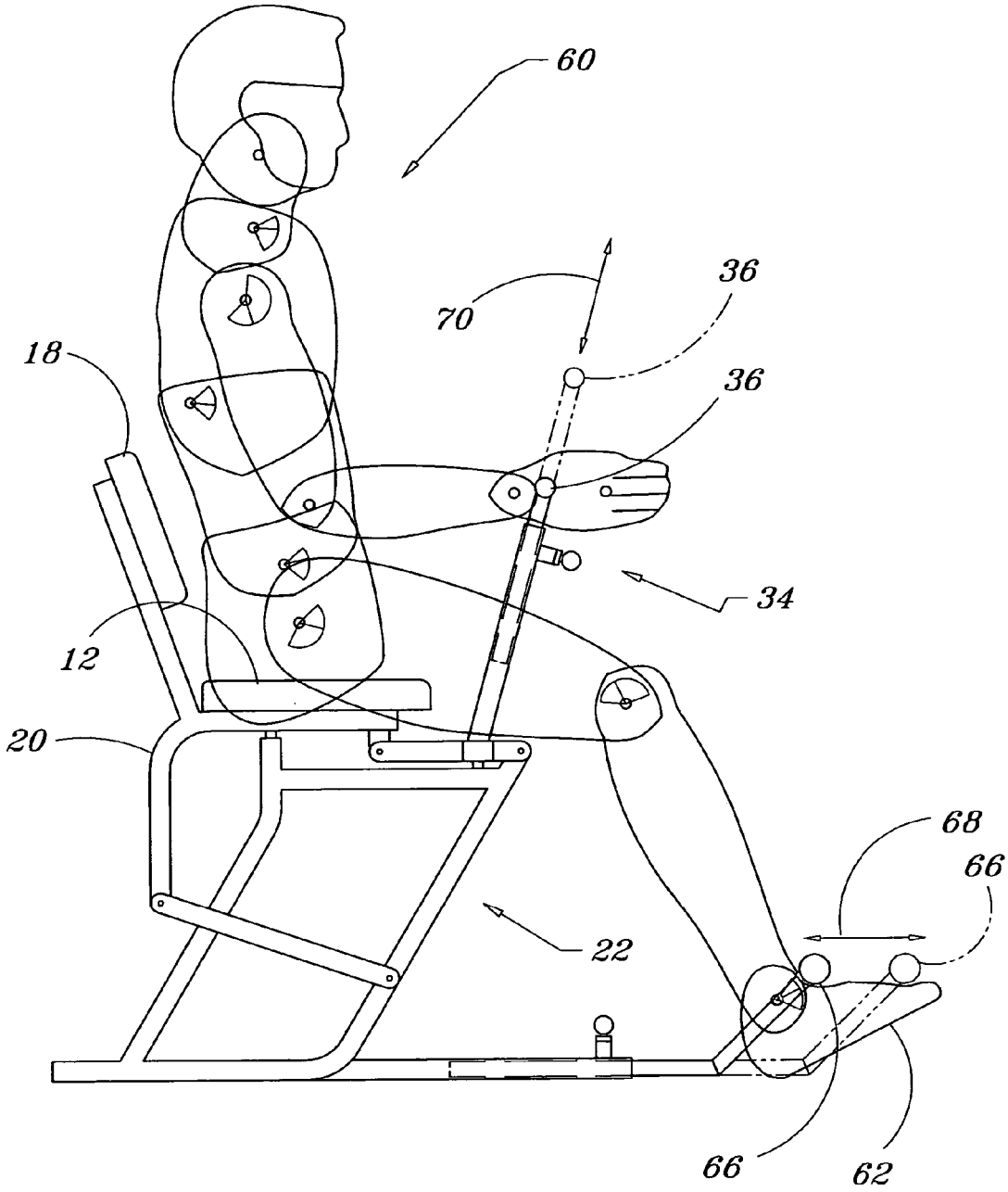
FIG. 4 is a side view of an abdominal exercise device with a front foot support and a backrest, the device shown in a starting position and produced in accordance with the preferred embodiment of the present invention.

Another variation is shown in FIG. 4. This shows a side view of an abdominal device with a seat back 18 mounted to the seat frame 20. The foot support has been modified in that it includes a front foot bar 66, which is positioned in front of the user 60 on the handle 34 side of the seat 12. This bar 66 provides a support that allows the user to position his feet 62 under the bar 66. When the user 60 pushes the handle 34 forward, the reaction force can be balanced by pulling back on the foot bar 66 with the user's feet 62. The foot bar 66 can be movably mounted to the base frame 22 and therefore can be adjusted into a desired position as depicted by the arrow 68. This adjustment is similar to the adjustment of the handle 34 as shown by the arrow 70 and as was previously noted. Another alternative is to fixably mount the foot bar 66 to the base frame 22 and in so doing remove the adjustment feature of the foot bar 66.

Figure 5:
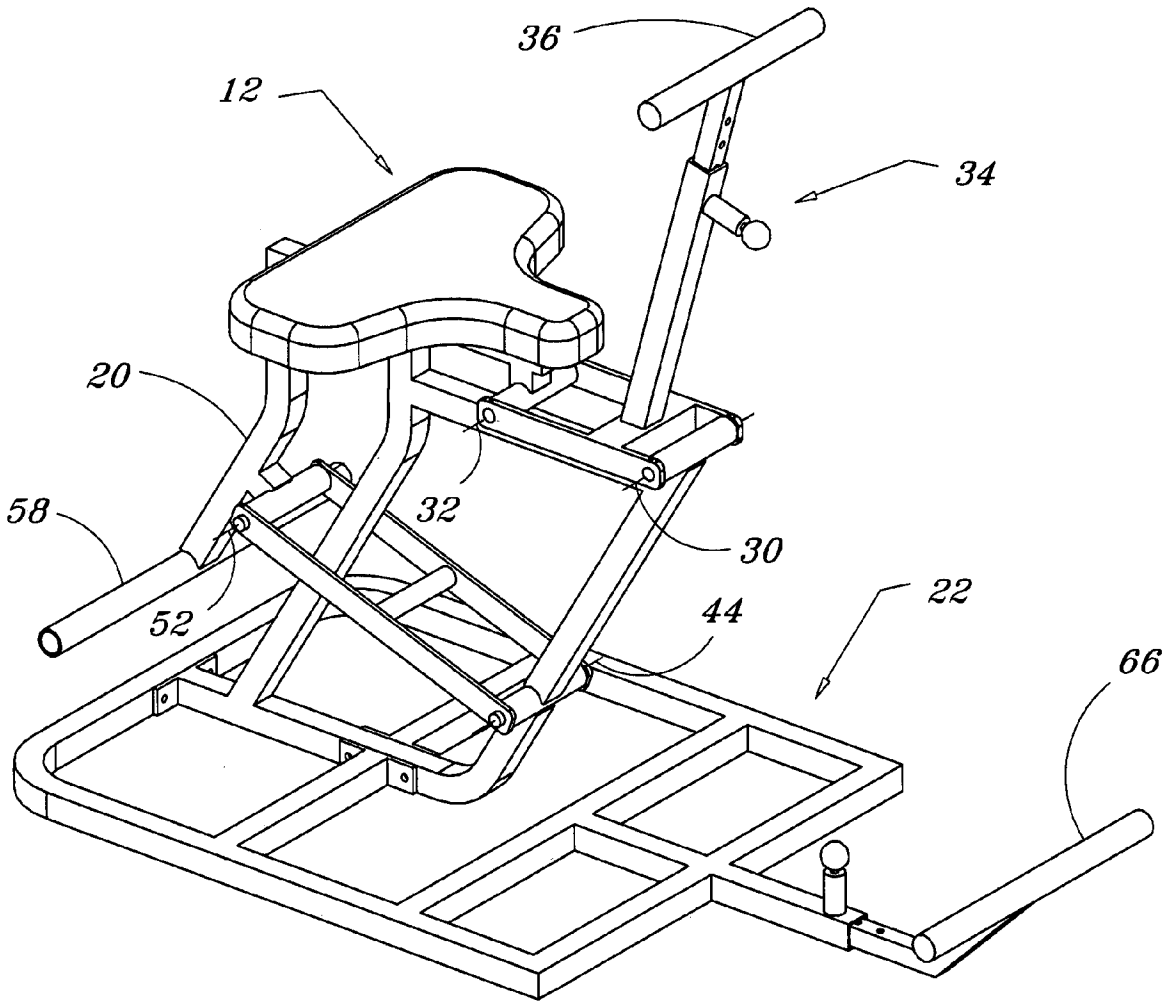
FIG. 5 is an isometric view of an abdominal exercise device with a front foot support and a rear foot support, the device shown in a starting position and produced in accordance with a version of the present invention.

The device can also include both the rear foot bar 58 and a front foot bar 66 as shown in FIG. 5. As previously noted, the front foot bar 66 and/or the rear foot bar 58 can be rigidly or movably mounted to their respective frames. The rear bar 58 is mounted to the seat frame 20 and the front foot bar 66 is mounted to the base frame 22. In this figure the front foot bar 66 is movably mounted to the base frame 22 and the rear foot bar 58 is rigidly mounted to the seat frame 20. Here the seat back 18 has been removed to illustrate the version without the seat back 18.

Figure 6:
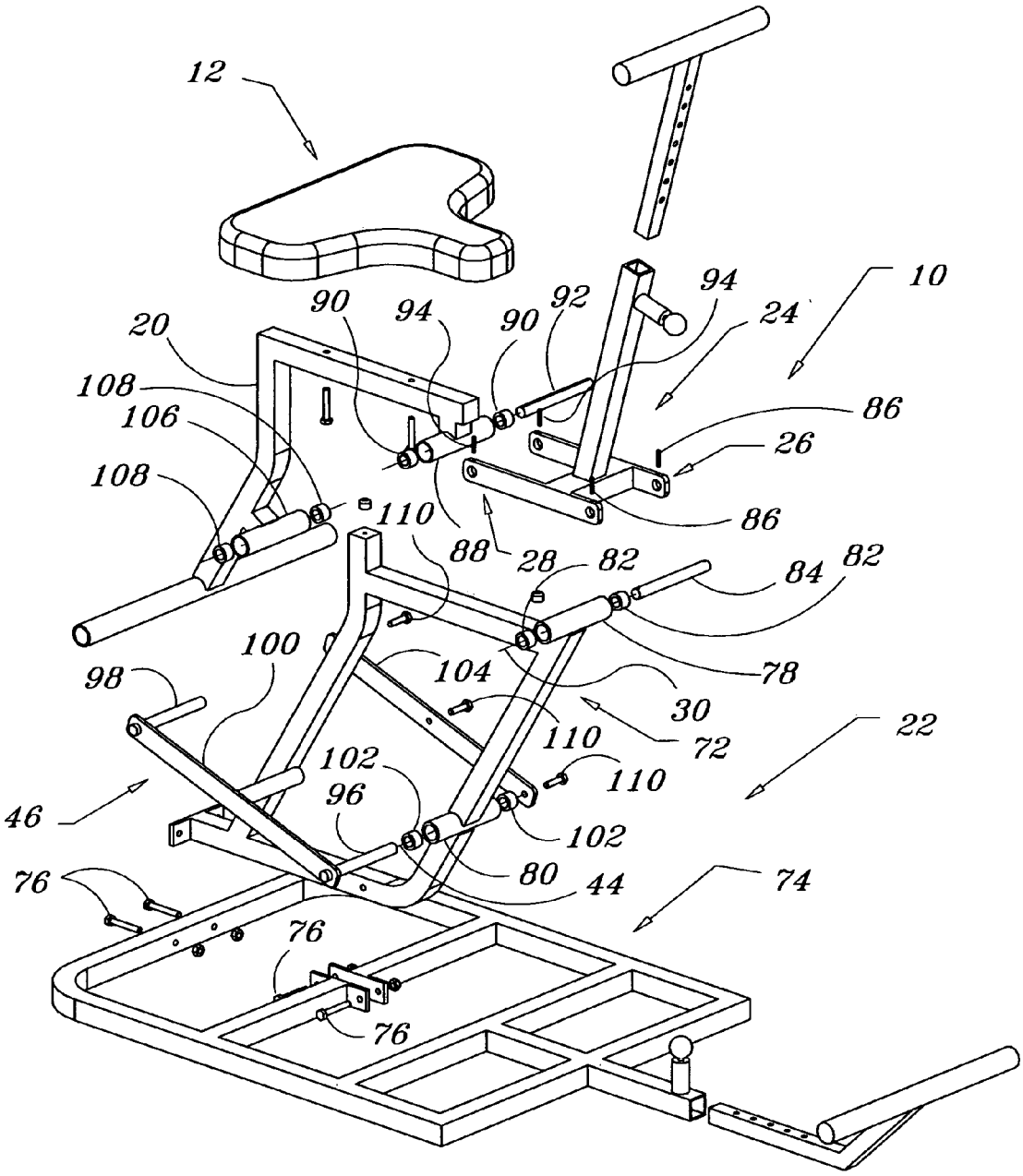
FIG. 6 is an exploded, isometric view of an abdominal exercise device with a front foot support and a rear foot support, the device produced in accordance with a version of the present invention.

An exploded view of the device 10 is shown in FIG. 6. This is the same form of the device as was shown assembled in FIG. 5. Here it can be more easily seen that the seat portion 12 is mounted to the seat frame 20. The base frame 22 is shown in two parts, the vertical component 72 and the base component 74. These are fastened together with the fasteners 76. The vertical component 72 includes the two supports for the first axis 30 and the second axis 44. These supports are shown here to be round tubing (78 & 80 respectively) that is welded to the vertical component 72 of the base frame 22. Bushings 82 are pressed inside the first axis tube 78 and the second axis tube 80 and the upper rod 84 rides on the bushings 82. The upper rod 84 is mounted to the first end 26 of the handle link 24 by way of the roll pins 86. The second end 28 of the handle link 24 is mounted to the third axis tube 88. In a similar manner, bushings 90 are pressed therein with the back rod 92 being received by the bushings 90 in the third axis tube 88. The rod 92 is secured to the second end 28 of the handle link 24 with the rear pins 94.

Another form of linkage pivot is shown with the guide link 46. In this form, the front rod 96 and the rear rod 98 are mounted to a side bar 100. The front bar 96 is received by the second axis tube 80, supported by bushings 102 and secured by a second side bar 104 on the other side of the tube 80. Likewise, at the rear, a fourth axis tube 106 is mounted to the seat frame 20 and receives bushings 108 and the rear rod 98. Fasteners 110 mount to the front rod 96 and rear rod 98 to hold the second side bar 104 in an assembled state with the side bar 100. Either form of linkages and pivots, using ball bearings or bushings can each be used for either movable link.

What is disclosed herein is the preferred embodiment as seen by the inventor. It is understood that an infinite number of variations including use of various designs and mountings could be used in place of what is disclosed and are therefore inherently considered part of the present invention.

What is claimed is:

1. An abdominal exercise device comprising:

a frame including a first axis and a second axis, said first axis and second axis are non-collinear;

a seat frame with a seat portion, the seat frame including a third axis and a fourth axis, said third axis and said fourth axis are non-collinear;

a handle link including a handle, the link including a first end pivotally mounted to said first axis and a second end pivotally mounted to said third axis;

a guide link having a continuously rigid body, wherein said continuously rigid body has a first end pivotally mounted to said second axis and a second end pivotally mounted to said fourth axis, whereby said handle is movable in a direction away from said seat portion, and whereby movement of the handle in said direction actuates said seat portion relative to said frame.

2. An abdominal exercise device as in claim 1, further comprising a foot support.

3. An abdominal exercise device as in claim 2, wherein said foot support is mounted to said seat frame.

4. An abdominal exercise device as in claim 3, wherein said foot support is movably mounted to said seat frame.

5. An abdominal exercise device as in claim 2, wherein said foot support is positioned opposite to said handle relative to said seat.

6. An abdominal exercise device as in claim 2, wherein said foot support is mounted to said frame.

7. An abdominal exercise device as in claim 3, wherein said foot support is on a same side as said handle relative to said seat.

8. An abdominal exercise device as in claim 1, wherein said handle is adjustably mounted to said handle link.

9. An abdominal exercise device as in claim 1, wherein said handle is slideably mounted to said handle link.

10. An abdominal exercise device as in claim 1, wherein said guide link is between 1.5 and 2.0 times the length of said handle link.

11. An abdominal exercise device as in claim 10, wherein said guide link is 1.7 times the length of said handle link.

12. An abdominal exercise device comprising:

a frame including a first axis and a second axis, said first axis and second axis are non-collinear;

a seat having a front portion and a rear portion;

a rear seat frame extending from the rear portion of said seat and a front seat frame extending from the front of said seat;

at least two links with at least one link pivotally mounted to said frame at said first axis and said second axis, wherein one of the at least two links is pivotally mounted to said rear seat frame and another of said at least two links is pivotally mounted to the front seat frame;

a handle mounted to one of said at least two links, whereby when said handle is movable in a direction away from said seat, and whereby movement of the handle in said direction actuates said seat relative to said frame.

13. An abdominal exercise device as in claim 12, further comprising a foot support.

14. An abdominal exercise device as in claim 13, wherein said foot support is mounted to said seat frame.

15. An abdominal exercise device as in claim 14, wherein said foot support is movably mounted to said seat frame.

16. An abdominal exercise device as in claim 13, wherein said foot support is positioned opposite to said handle relative to said seat.

17. An abdominal exercise device as in claim 13, wherein said foot support is mounted to said frame.

18. An abdominal exercise device as in claim 13, wherein said foot support is on a same side as said handle relative to said seat.

19. An abdominal exercise device as in claim 12, wherein said handle is adjustably mounted to said handle link.

20. An abdominal exercise device as in claim 12, wherein said handle is slideably mounted to said handle link.

21. An abdominal exercise device as in claim 12, wherein said guide link is between 1.5 and 2.0 times the length of said handle link.

22. An abdominal exercise device as in claim 21, wherein said guide link is 1.7 times the length of said handle link.

23. An abdominal exercise device comprising:

a base frame including a first axis and a second axis, said first axis and second axis are non-collinear;

a seat frame with a seat portion, the seat frame including a third axis and a fourth axis, said third axis and said fourth axis are non-collinear;

a handle link including a handle, the link including a first end pivotally mounted to said first axis and a second end pivotally mounted to said third axis;

a guide link having a continuously rigid body, wherein said continuously rigid body has a first end pivotally mounted to said second axis and a second end pivotally mounted to said fourth axis;

wherein in an operating configuration, the handle is movable in a direction away from the seat portion, and movement of the handle in said direction rotates the handle link about the first axis and rotates the guide link about the second axis, while maintaining the base frame in a stationary position.

* * * * *